United States Patent [19]

Watkins

[11] 4,333,526

[45] Jun. 8, 1982

[54] ANNULUS VALVE

[75] Inventor: Bruce J. Watkins, Rancho Palos Verdes, Calif.

[73] Assignee: Hughes Tool Company, Houston, Tex.

[21] Appl. No.: 37,841

[22] Filed: May 10, 1979

[51] Int. Cl.[3] ..... E21B 34/02

[52] U.S. Cl. ..... 166/87; 166/72; 166/88

[58] Field of Search ..... 166/72, 86, 87, 88, 166/89, 316, 129; 137/869

[56] References Cited

U.S. PATENT DOCUMENTS

| | | | |
|---|---|---|---|
| 1,902,540 | 3/1933 | Brown | 166/87 |
| 3,360,048 | 12/1967 | Watkins | 166/87 |
| 4,049,052 | 9/1977 | Arendt | 166/183 |
| 4,109,712 | 8/1978 | Regan | 166/87 X |
| 4,125,155 | 11/1978 | Brock, Jr. | 166/87 X |

*Primary Examiner*—William F. Pate, III

*Attorney, Agent, or Firm*—Robert A. Felsman; Guy Porter Smith

[57] ABSTRACT

An annulus valve apparatus integrated within a tubing hanger controls fluid flow through a tubing-casing annulus formed between a casing and a tubing string located within and generally concentric to the casing and connected to the tubing hanger. The tubing hanger is landed within the casing and sealing relation thereto and divides the annulus into an upper and lower portion. Fluid flow passages located within the hanger body communicate between the portions of the annulus above and below the hanger. An annulus opening means, mounted to the hanger body, allows fluid to pass between the fluid flow passages and the portion of the annulus below the hanger. The opening means is spring biased to close the passages to fluid flow. A plurality of control fluid passages in the hanger body communicate between the opening means and the hanger bore, which is aligned with the tubing bore, and pass a hydraulic control fluid from the hanger bore to the opening means. The control fluid communicates with a shoulder on the inner surface of the opening means. When the pressure of the control fluid on the shoulder portion of the opening means is greater than the biasing force on the opening means provided by the springs, the opening means is moved by the fluid along the hanger body to a position which opens the passages to fluid flow between upper and lower portions of the annulus. The hydraulic fluid is supplied to the hanger bore by means of a tubing mandrel positioned therein.

6 Claims, 4 Drawing Figures

10
12
26
22
82
17
18
16
22
24
28
80
14
30
30
32
34
36
48
56

ANNULUS VALVE

FIELD OF THE INVENTION

The present invention relates to apparatus for controlling fluid flow through an annulus formed between generally concentric conduits such as oil well casings and tubing strings suspended within the casing. More particularly, the present invention relates to tubing hangers containing integrated annulus valves which are hydraulically activated through passages in the tubing hangers.

BACKGROUND OF THE INVENTION

In oil well drilling and production operations in both land and subsea locations, oil, mud, and hydraulic fluids are normally transmitted through an annulus formed between successive generally concentric casings. In particular, such fluids are transmitted through an annulus defined by an oil well casing and a tubing string suspended within the casing. Quite often, these fluids are transmitted under very high pressure with flow directions through the annulus being in opposite directions during various operations at the oil well.

It has long been a problem to effectively control the flow of these high pressure fluids through the annulus created by the concentric conduits. Various solutions to this problem are found in the prior art. For example, one solution has been to seal the annulus by sealing elements within the casing to prevent fluid passage through the annulus. An access port into the annulus is then provided through the sealing elements. Fluid flow into or out of the sealed annulus is controlled by means of a valve external to the sealing elements at the access port. Such an arrangement presents many problems, especially where the casing is not readily available, as is the case in subsea oil well drilling and production operations where the casing head may be on the seafloor hundreds of feet below a drilling platform from which drilling and production operations are being conducted. Additionally, with this type of arrangement, the fluid flow within the annulus is not controlled from within the annulus itself, but must be directed through a valve external of the annulus. This requires additional piping and controls, which are undesirable in subsea oil well drilling and production operations. It is particularly essential to be able to easily and effectively seal off the annulus in such subsea operations since other fluid control means embodied in blow-out prevention equipment, or a production control trees, for example, must be periodically removed during the course of the drilling and production operations.

Another solution found in the prior art, and described by U.S. Pat. No. 3,360,048, issued to this inventor on Dec. 26, 1967, is to suspend an annulus valve from a tubing hanger landed in sealing relation within an oil well casing. The annulus valve divides the tubing-casing annulus into two portions, and passages are provided between the two portions. A closure means is provided to seal the opening between the portions of the annulus, and thus to prevent fluid flow therethrough. Such closure means is operated by wire line tools positioned within the hanger bore. However, a problem with such an arrangement is that a tool adapted to operate the closure means necessarily has to be inserted into the hanger bore. Additionally, such a valve is a discrete component in the oil well equipment string, which utilizes space in the string into which another tool or apparatus could otherwise be inserted.

As hydraulic fluid is frequently utilized in oil wells to control various devices within the well, it would be attractive to eliminate the dependence on wire line tools or other such devices for controlling an annulus valve, and to utilize instead the hydraulic fluid to control the valve. Such fluid is frequently available from tubing mandrels attached to production trees. It would be also attractive to combine an annulus valve with another component in an oil well, such as a tubing hanger.

Accordingly, it is the principal object of the present invention to control fluid flow through an annulus formed between an oil well casing and a tubing string suspended therein in a manner not requiring the use of separate control elements external to the casing or positioned within the tubing bore.

It is another object of the present invention to control fluid flow through a tubing-casing annulus in an oil well installation through the use of hydraulic control fluid.

It is an additional object of the present invention to integrate an annulus valve into a tubing hanger positioned within the casing.

It is still another object of the present invention to allow actuation of an annulus valve integrated within a tubing hanger by the insertion of a tubing mandrel into the tubing hanger.

It is another object of the present invention to provide an annulus valve which may be easily inserted and removed from an oil installation.

It is also an object of the present invention to control fluid flow through a tubing-casing annulus formed between a casing and an inner tubing by way of an apparatus landed within the casing in sealing relation and dividing the annulus into an upper and lower portion, where the apparatus is connected to the tubing and has an apparatus bore communicating with the tubing bore and passages communicating between the upper and lower portions of the annulus, and also has hydraulically-activated means, communicating with the tubing bore, for opening the passages to fluid flow between the annulus portions.

It is the final object of the present invention to provide an annulus valve capable of equalizing fluid pressures exerted on opposite sides of the moving parts of the valve to balance their effects on opening and closing operations under high fluid pressures in the well.

SUMMARY OF THE INVENTION

The present invention, in a broad aspect, involves an annulus valve apparatus which controls fluid flow through a tubing-casing annulus formed between a casing and an tubing string located within and generally concentric to the casing. The apparatus, which is connected to the tubing string and which has an apparatus bore communicating with the tubing bore, is landed within the casing in sealing relation and thereby closes the portion of the annulus below the apparatus. The annulus valve apparatus includes passages which communicate between the portions of the tubing-casing annulus above and below the apparatus, and a hydraulically-activated opening means which allows fluid to flow through the passages. The opening means is activated by hydraulic control fluid supplied to the apparatus from a remote location. The hydraulic fluid activates the opening means from a closed to an opened position relative to the passages.

In accordance with one feature of the invention, the opening means is a generally cylindrical sleeve member slideably moveable in the portion of the tubing-casing annulus below the apparatus to open and closed positions relative to the locations where the passages communicate with the portion of the annulus below the apparatus. The sleeve member includes, on its inner surface, a shoulder which receives the hydraulic fluid, the force of the fluid on the shoulder moving the sleeve member to the open position. The hydraulic fluid is supplied to the shoulder by at least one control fluid passage in the apparatus which communicates between the opening means and the apparatus bore. Hydraulic fluid is supplied to the apparatus bore from a remote location by means of a tubing mandrel or other device inserted therein.

In accordance with another feature of the invention, the sleeve member is urged to a position closing the passages to fluid flow by spring members. The moving of the opening means from a position closing the passages to a position opening the passages is done when the pressure of the hydraulic fluid on the shoulder is greater than the force on the sleeve member supplied by the spring members.

In accordance with another feature of the invention, a plurality of ring-like seals on the apparatus prevent the control fluid from entering the annulus, and also prevent fluid from the fluid passages from entering the annulus when the opening means closes the passages.

In accordance with a further feature of the invention, an annulus valve apparatus for use in controlling fluid flow through a tubing-casing annulus is integrated with a tubing hanger landed in sealing relation within the casing and closing the annulus. The tubing hanger has a bore communicating with the tubing bore and connects to a tubing string within and generally concentric to the casing. The tubing hanger divides the tubing-casing annulus into an upper portion and a lower portion, and fluid flow passages within the hanger body communicate between the portions. A generally cyclindrical body mounted on the hanger body adjacent to where the flow passages communicate with the portion of the annulus below the tubing hanger is biased by a plurality of springs to a position which closes the passages to fluid flow. A plurality of control fluid passages located in the hanger body and communicating with a shoulder in the cylindrical body route a hydraulic control fluid from the hanger bore to the shoulder. When the pressure of the control fluid on the shoulder is greater than the force of the springs urging the cylindrical body to a position which prevents fluid flow through the passages, the cylindrical body is moved by the fluid to a position which opens the passages to fluid flow therethrough. As described previously, a plurality of ring-like seals on the hanger prevent inadvertent fluid flow from the fluid flow passages or the control fluid passages into the portion of the annulus below the tubing hanger.

In accordance with still another feature of the invention, control fluid may be passed into the tubing hanger containing the integrated annulus valve by a tubing mandrel positioned within the hanger bore.

In accordance with a final feature of the invention, the control fluid passages in the tubing hanger may form part of a hydraulic control line passing from the hanger through the portion of the tubing-casing annulus below the hanger to other devices in an oil well casing, thereby allowing hydraulic control to be exerted over these devices.

Other objects, features, and advantages of the apparatus in accordance with the present invention will become readily apparent to those skilled in the art from a consideration of the following detailed description of an exemplary embodiment of the apparatus in accordance with the present invention and of the accompanying sheets of drawings.

DETAILED DESCRIPTION

Figure 2A:
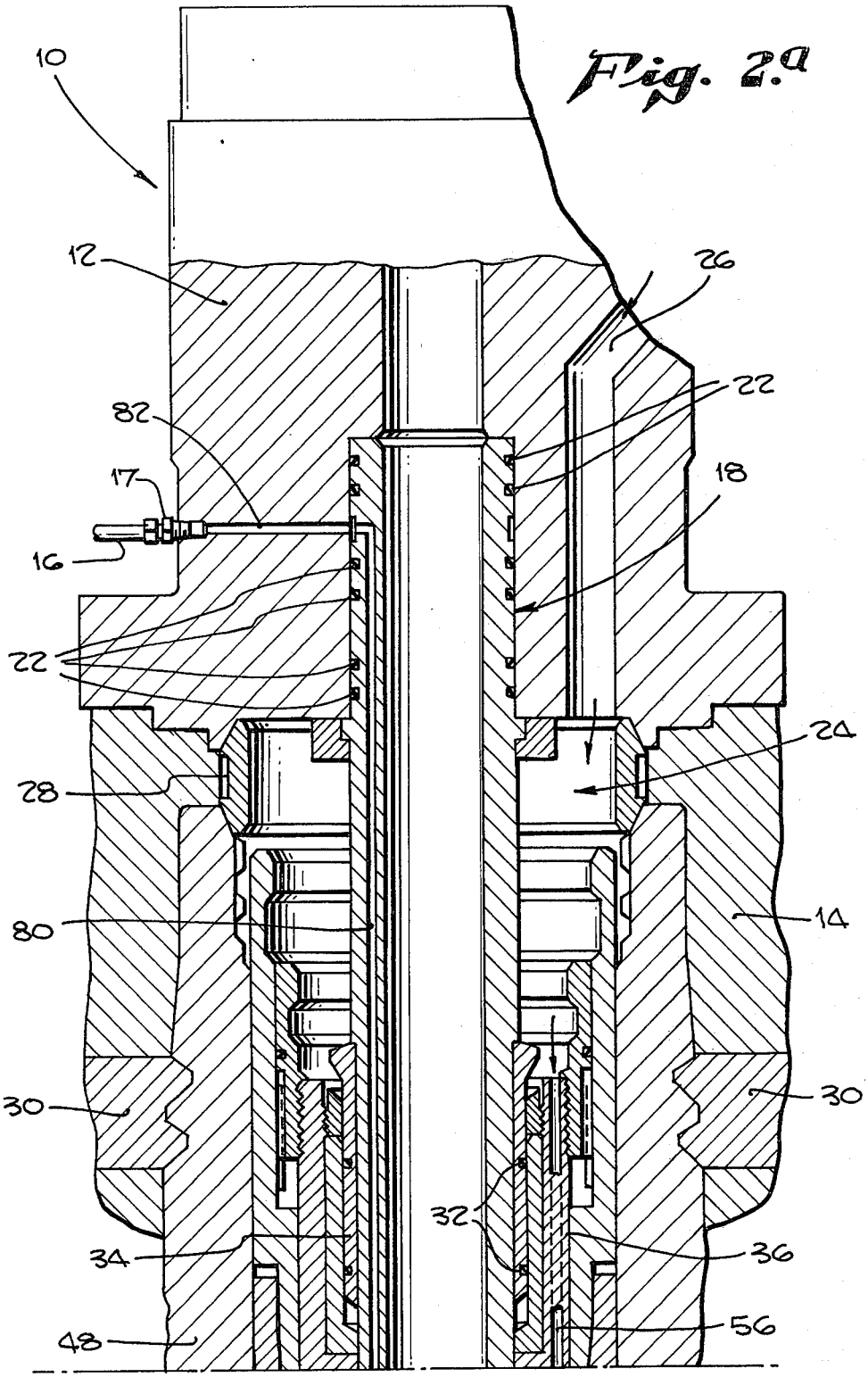
FIGS. 2*a* and 2*b* are cross-sectional view of the annulus valve of FIG. 1, shown for exemplary purposes only in an oil well installation of the subsea type.

Referring to FIG. 2, a portion of exemplary form of a subsea wellhead Christmas tree 12 is shown seated upon an oil well casing 48. The Christmas tree 12 is secured to the casing 48 by an cylindrical latch assembly 14. The latch assembly 14 is mounted to the casing 48 by locking ring 30, and secures the Christmas tree 12 to the casing 48 by means of a locking flange 28, which engages a mounting groove 86 in the Christmas tree 12.

Figure 1:
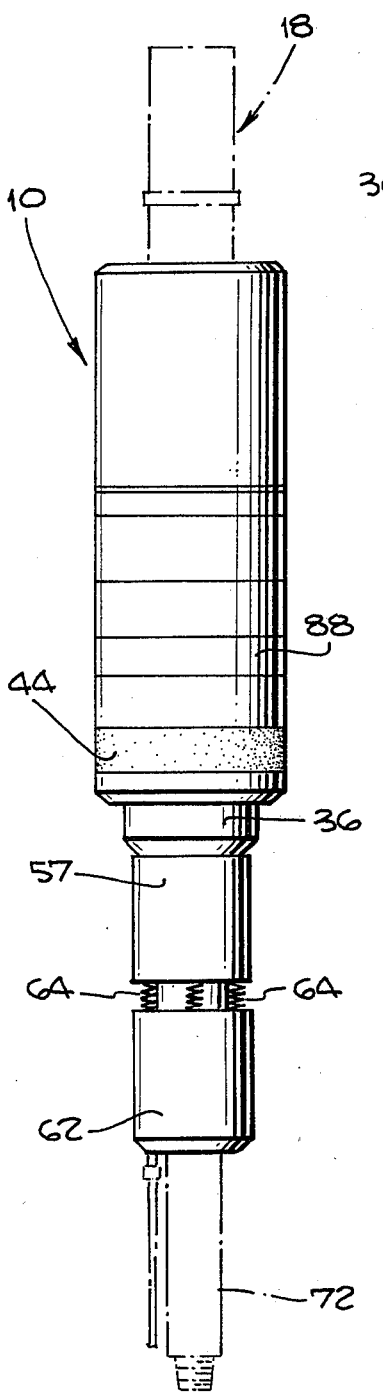
FIG. 1 is an elevational view of an exemplary embodiment of an annulus valve in accordance with the present invention.

Referring to FIGS. 1 and 2, an exemplary tubing hanger incorporating an annulus valve is shown generally at 10. The tubing hanger 10 has a generally cylindrical upper body and a generally cylindrical lower body of smaller diameter. The tubing hanger 10 is landed in the casing 48 in sealing relation. Accordingly, the tubing hanger 10 rests upon a landing surface 46 in the casing 48. A packing assembly 44 and a compression ring 88 seal the area between the casing 48 and the tubing hanger 10.

Suspended from the tubing hanger 10 is a series of oil well tubings 72. The tubing 72 are secured to the tubing hanger 10 by means of threads 74 in the lower portion of the tubing hanger 10. In this manner, the tubing hanger 10 suspends the tubing 72 generally concentrically within the tubing casing 48 and the hanger bore 92 is aligned with the tubing bore 94. With this orientation, an annulus 70 is created below the tubing hanger 10 between the casing 48 and the tubing 72 therein suspended by the tubing hanger 10.

Attached to the Christmas tree 12, and positioned within the bore 92 of the tubing hanger 10 is a tubing mandrel 18. The tubing mandrel 18 rests on a landing surface in tubing hanger 10 and is secured within the tubing hanger 10 by means of the wellhead latch 14, and by sleeve 34 which engage corresponding surfaces in the tubing hanger 10. The tubing mandrel 18 is sealingly mounted to the Christmas tree 12 by means of sealing rings 22, and is sealingly positioned within the tubing hanger 10 by means of sealing rings 32. This particular orientation of the tubing mandrel 18 within the tubing hanger 10 results in the mandrel bore 20 being aligned with the hanger bore 92 and the tubing bore 94. Additionally, this orientation results in an annulus 24 being formed above the hanger 10 between the casing 48 and the tubing mandrel 18. This annulus 24, as shown in FIG. 2, is immediately adjacent to the top of the tubing hanger 10. The annulus 70 below the hanger 10 and the annulus 24 above the hanger 10 can be viewed, and is viewed herein, as the lower and upper portions of a single tubing-casing annulus which has been divided by the tubing hanger 10.

During oil well drilling and/or production operations, it is frequently necessary to control fluid flow between the upper portion 24 and the lower portion 70 of the annulus. Such fluid flow may be either up or down between the annulus portions and may be connected with the flow of fluid up or down within the tubing bore 94. As shown in FIG. 2, the upper annulus portion 24 is interconnected to the Christmas 12 by means of a passage 26. The Christmas tree passage 26 is connected to the other mechanisms in the Christmas tree which utilize or create, the fluid flow through the annulus. For purposes of describing the present exemplary embodiment of the tubing hanger containing an integrated annulus valve, it is the fluid flow between the lower portion of the annulus and the upper portion 24 of the annulus which is to be controlled. Therefore, the exemplary embodiment of the tubing hanger 10 is disposed in the apparatus to control fluid flow between these annulus portions 24 and 70. However, it is to be understood, that the annulus valve of the present invention may be employed in association with any annulus formed between casing and tubing members whether generally concentric or not and that the present description of subsea oil well apparatus in which the tubing hanger containing an integrated annulus valve may be employed is exemplary of but a single use of the annulus valve in the present invention.

Coming now the exemplary embodiment of the tubing hanger 10 containing an integrated annulus valve 10 in accordance with the present invention, reference will be made to the elevational view of FIG. 1 and the detail cross-sectional views of FIGS. 2 and 3. The tubing hanger 10 has, as mentioned, a generally cylindrical body 36, which has been landed in casing 48 in sealing relation thereto. Within the hanger body 36 are one or more fluid flow passages 56 which extend from the upper portion 24 of the annulus through the hanger body 36 and into the lower portion 70 of the annulus. It is through these passages 56 that fluid flows between the lower portion 70 and the upper portion 24 of the tubing-casing annulus. As mentioned, Christmas tree passage 26 routes fluid between the upper portion 24 of the annulus and other devices connected to the Christmas tree 12.

Figure 2B:
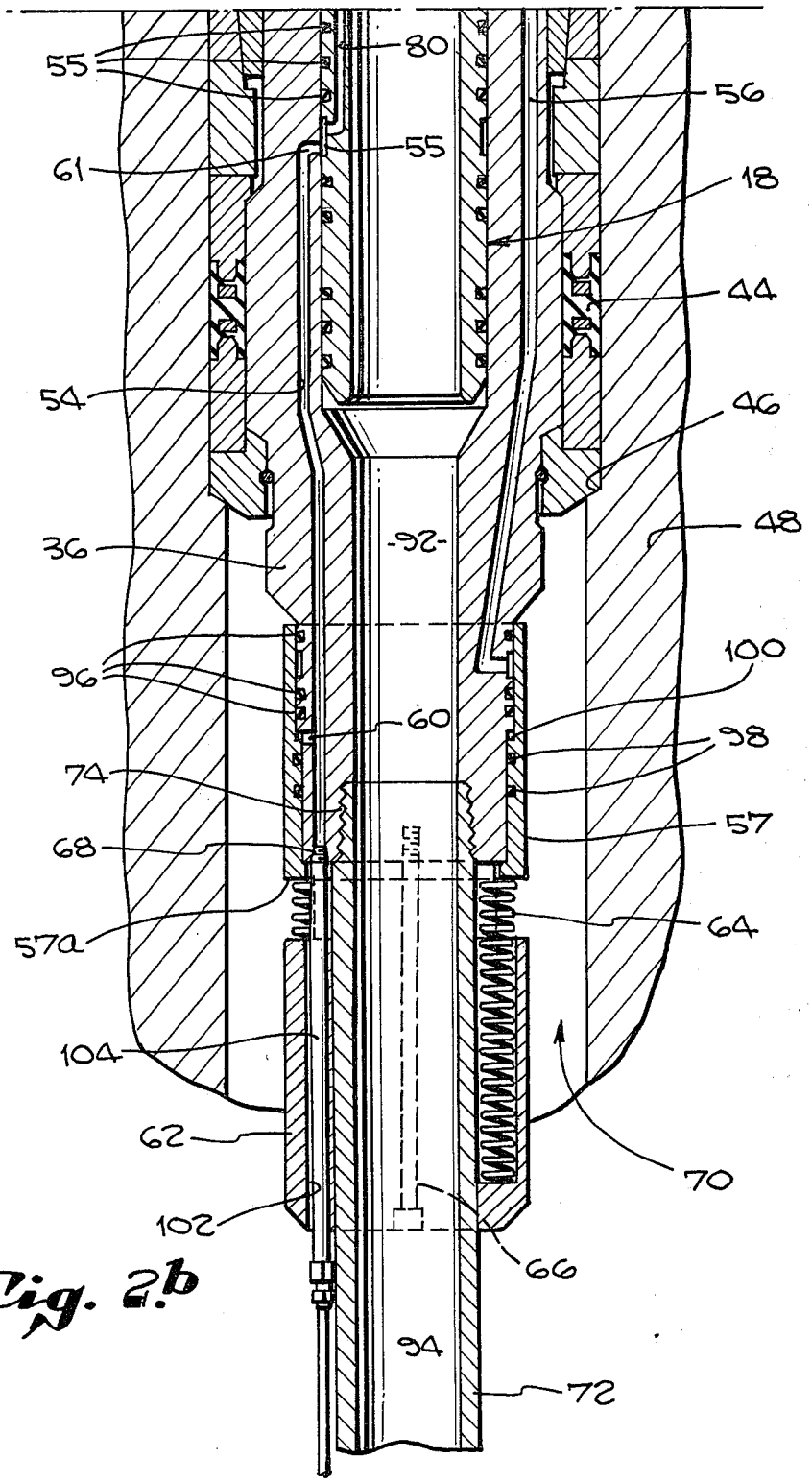

On the lower outside portion of the hanger body 36 is a generally cylindrical, slidably-mounted, sleeve member 57. The sleeve member 57 is positioned so as to open and close the fluid flow passage openings 58 to the lower annulus portion 70. FIGS. 2*b* and 3 show the fluid flow passage openings 58 being closed and opened, respectively, relative to the lower portion 70 of the annulus by the relative position of the sleeve member 57. A plurality of sealing rings 96 on the hanger body 36 prevent fluid from passing between the flow through passages 56 and the lower portion 70 of the annulus when the sleeve member 57 is in a closed position, as shown in FIG. 2*b*. The sealing rings 96 project outwardly from the hanger body 36 and sealingly about the sleeve member 57.

It is thus seen that the valve portion of the tubing hanger 10 is comprised of the fluid flow passages 56, which communicate between the upper 24 and the lower 70 portions of the annulus, of the sleeve member 57, which allows or prevents fluid from flowing through the passages 56, and of the control mechanism for the valve, which is described hereinafter.

The movement of the sleeve member 57 relative to the passage openings 58 is done by hydraulic control. In this regard, one or more control fluid passages 54 are provided in the hanger body 36. These control fluid passages 54 communicate between control fluid passage openings 60 adjacent to the sleeve member 57 and openings 61 communicating with the tubing hanger bore. The openings 61 in the tubing hanger bore communicate with a circular chamber 55 around the outer surface of the tubing mandrel 18 inserted within the hanger body 36. This chamber 55 connects to the one or more control fluid passages 80 in the tubing hanger. The chamber 55 is utilized to ensure communication between the control fluid passages 80 in the tubing mandrel 18 and the control fluid passages 54 in the tubing hanger body 36. That is, in order to obviate the necessity for precise positioning of the tubing mandrel 18 in the hanger body 36, the chamber 55 is provided which allows communication between the control fluid passages 54 in the tubing hanger 10 and the corresponding passages 80 tubing mandrel 18 if entry of the mandrel into the hanger has not quite been completely achieved.

The control fluid passages 80 in the tubing mandrel 18 connect to a control fluid passage 82 in the Christmas tree 12 by means of a mandrel chamber 84. The control fluid passages 82 in the Christmas tree 12 connects to a hydraulic control line 16 by means of a connector 17. The hydraulic control line 16 utilized to control the valve apparatus may also be used to control several other devices within the oil well casing 48.

The openings 60 of the control fluid passage 54 in the hanger body 36 are located above a shoulder 100 on the inner surface of the sleeve member 57. In this manner, hydraulic fluid is transferred from the control fluid passages 54 to the sleeve member 57. A plurality of sealing rings 96 on the hanger body abut the sleeve member 57 above the shoulder 100, and a plurality of sealing rings 98 on the sleeve member abut the hanger body 36 below the shoulder 100 to ensure that the lower annulus portion 70 is completely sealed from any hydraulic control fluid.

Beneath the sleeve member 57 is a lower hanger body 62. The lower hanger body 62 is attached to the primary hanger body 36 by means of a plurality of screws 66 which pass into threaded holes in the primary hanger body 36 by means of passages in the lower hanger body 62. The lower hanger body 62 supports a plurality of springs 64 which abut the sleeve member 57 at its bottom surface 57*a*. The springs 64 bias the sleeve member 57 in a position to seal the fluid flow passage openings 58 from the lower portion annulus 70 of the tubing-casing annulus.

In operation, the sleeve member 57 is biased by the springs 64 to close the fluid flow openings 58 when no hydraulic fluid is supplied to the control fluid passages 54 in the hanger body 36 by means of the hydraulic control line 16, and the passages 82 in the Christmas tree 12 and the passages 80 in the tubing mandrel 18. When hydraulic fluid is passed from the hydraulic control line 16 through these control fluid passages, the fluid is directed by the control fluid passage 54 in the hanger body 36 to the shoulder 100 in the sleeve member 57. When the pressure of the hydraulic fluid on the shoulder 100 is greater than the force of the springs 64 against the bottom surface 57*a* of the sleeve member 57, the sleeve member 57 is moved by the fluid away from the fluid flow passage openings 58, thus exposing the openings to the lower portion 70 of the annulus. Thus, fluid is allowed to flow between the lower portion 70 and the upper portion 24 of the annulus. The sleeve member 57 remains in this open position relative to the fluid flow openings 58 until the pressure of the hydraulic fluid on the shoulder 100 becomes less than the force of the springs 64 on the bottom of the sleeve member 57, whereupon the sleeve member will again be biased by the springs 64 to cover the fluid flow passage openings 58, and thus to stop the passage of fluid between the lower annulus portion 70 and the upper annulus portion 24.

It is thus seen that the operation of the annulus valve integrated into the tubing hanger 10 is as follows. First, the springs 64 urge the sleeve member 57 toward the fluid flow passage openings 58 in a manner that will cause the sleeve member 57 to seal the openings 58 until a hydraulic fluid having a pressure greater than the force exerted by the springs is directed toward the shoulder 100 in the sleeve member 57. At that time, the control fluid will move the sleeve member 57 away from the openings 58 and thus allow communication between the lower annulus 70 and the upper annulus 24.

In the above description, hydraulic fluid and springs have been mentioned as the means by which the sleeve member 57 is moved to open and close the fluid passage openings 58. It is to be understood, however, that other control fluids and other biasing means could be utilized to move the sleeve member so as to expose, cover, respectively, the fluid passage openings.

Figure 3:
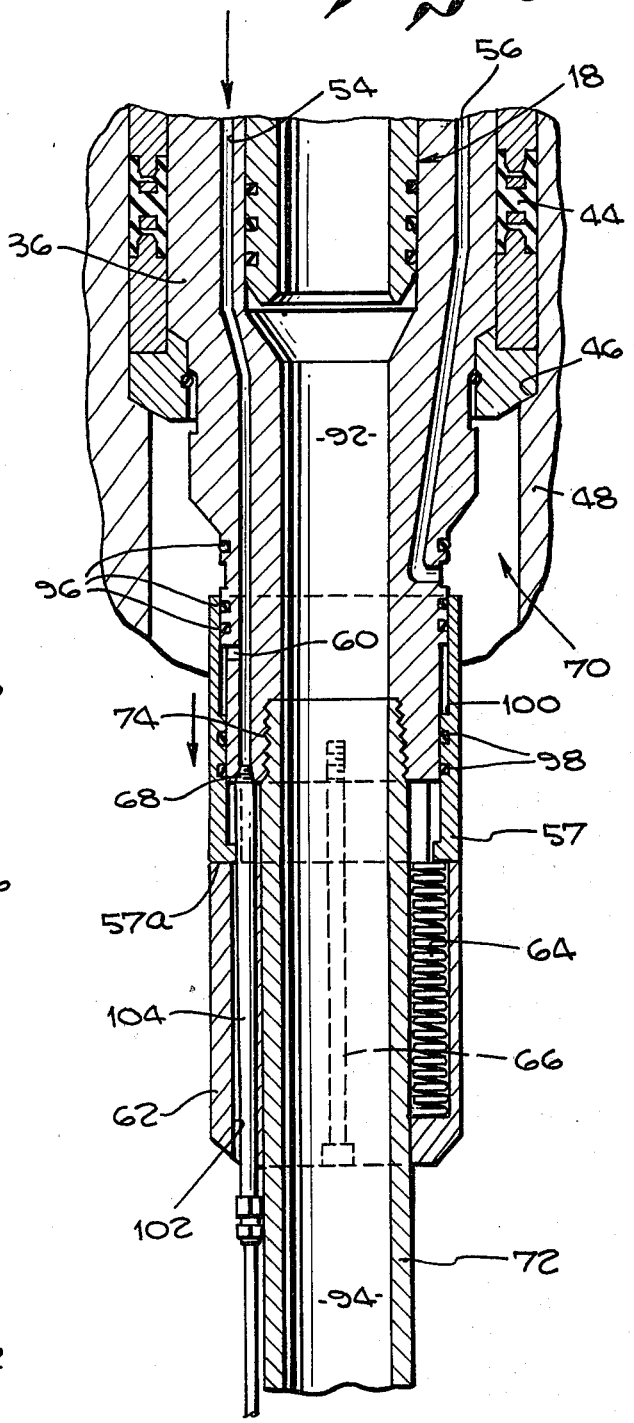
FIG. 3 is a detail cross-sectional view of the exemplary annulus valve shown in FIG. 2.

As shown in FIGS. 2 and 3, the lower hanger body 62 may be provided with one or more passages 102 to pass an auxiliary hydraulic control tube 104 through the lower hanger body 62 to the control fluid passages 54 in the primary hanger body 36. In this regard, the auxiliary tube 104 connects to the control fluid passages 54 in the primary hanger body 36 by means of a connector 68. If such an auxiliary control tube 104 is not utilized, the connector 68 would be replaced by a plug or similar device to seal the bottom of the control fluid tube 54 to prevent the hydraulic fluid from entering the lower portion 70 of the annulus.

The auxiliary tube 104 could be used, for example, to pass hydraulic fluid to other devices within the oil well casing 48. The control fluid passages in the Christmas tree 12, mandrel 18, and hanger body 36, and the control fluid passage provided by the auxiliary tube 104 may all additionally comprise a control passage to a subsurface safety valve. Such a valve could be of the type activating the well when hydraulic fluid is passed into the passage. If the connection between the Christmas tree 12 and the casing 48 were for some reason severed, the hydraulic control fluid would no longer pass through the passages and the absence of the fluid would operate the safety valve to close the wellhead. That is, if the sleeve member 57 was, by means of the shoulder 100, pushed by the hydraulic control fluid to expose the fluid flow openings 58 to the lower annulus portion 70, the sudden severing of the connection between the Christmas tree 12 and the casing 48 would reduce the hydraulic pressure in the control fluid passage 54 to a negligible level, thereby allowing the springs 64 to push the sleeve member 57 to a position closing the fluid passage openings 58 to the lower portion 70 of the annulus. As explained, this would cause communication between the upper 24 and the lower 70 portions of the annulus to immediately cease.

From the foregoing detailed description of an exemplary embodiment of a tubing hanger containing an annulus valve, in accordance with the present invention, it can be readily seen that the annulus valve is capable of effecting a positive opening of an annulus, such as between upper and lower portions of a tubing-casing annulus in a subsea oil well installation, by the use of hydraulic control fluid to move the cylindrical sleeve member 57 from a closed to an open position relative to the fluid flow passage openings 58. Further, the tubing hanger with the integrated annulus valve is easily and automatically positioned in the well ready for operation by the lowering and seating of the tubing hanger within the casing. The high well fluid pressures exerted on the valve portion of the tubing hanger are effectively balanced by the design of the lower portion of the hanger and the valve portion of the hanger is easily operated to allow communication between the upper and lower portions of the tubing-casing annulus.

Having thus described an exemplary embodiment of a tubing hanger containing an integrated annulus valve for controlling fluid flow through upper and lower portions of an annulus formed between a oil well casing and a tubing and a tubing mandrel preferably mounted concentrically therein, it should be noted that the foregoing description is exemplary of the present invention only, and that various modifications, adaptations, changes and alterations can be made in the apparatus of the present invention which come within the scope thereof and as is defined and limited only by the claims which follow. Thus, by way of example and not of limitation, the fluid flow passages could be oriented differently in the hanger body to communicate with the upper and lower portions of the tubing-casing annulus; the sleeve member could be shaped or oriented differently than as described; control fluid passages communicating with the casing could be used to pass hydraulic fluid to the sleeve member to effect an opening of the fluid flow passages: and, control fluids other than those hydraulic could be utilized to control the sleeve member. Accordingly, the invention is not limited to the particular arrangement which has been illustrated and described in detail.

What is claimed is:

1. In an annulus valve apparatus for controlling fluid flow through a tubing-casing annulus formed between a casing and an inner tubing, said apparatus having a tubing hanger body landed within said casing in sealing relation thereto closing said annulus, said apparatus comprising:

passage means communicating between portions of said tubing-casing annulus above and below said tubing hanger body for passing fluid therebetween;

hydraulically-actuated means for opening said passage means to fluid flow therethrough; and means for supplying hydraulic fluid to said opening means from a location remote therefrom, said fluid activating said opening means from a closed to an open position relative to said passage means, the improvement wherein said means for opening comprises:

a generally cylindrical sleeve member slidably movable on said body between positions opening and closing said passage means and having an internal hydraulic fluid receiving annular chamber formed between said sleeve member and said body; and said means for supplying hydraulic fluid includes a tubing mandrel run from said remote location and removably inserted concentrically into said hanger body, said mandrel having at least one control fluid passage therein and said body having a second fluid passage opening to said chamber and communicating with said mandrel control fluid passage when said mandrel is inserted in said hanger body, for supplying said hydraulic fluid to slide said sleeve member to said open position.

2. An annulus valve as defined in claim 1, wherein said sleeve member includes annular shoulder means formed on the interior of said sleeve member and forming a wall of said chamber for receiving said hydraulic fluid, the force of said hydraulic fluid on said shoulder means moving said sleeve member to said open position.

3. An annulus valve for use in controlling fluid flow through a tubing-casing annulus in an oil well equipment base, said tubing-casing annulus being formed between a casing and a tubing, said tubing being within and generally concentric to said casing and connected to a tubing hanger landed within said casing in sealing relation thereto closing said annulus, said hanger having a hanger bore aligned with the tubing bore, said hanger bore accepting a mandrel member communicating with said tubing bore, said hanger having flow-through passages communicable between portions of said tubing-casing annulus above and below said hanger, said valve being integrated with said hanger and comprising:

a generally cylindrical body, having an inner surface and an outer surface, slidably mounted to said hanger within said portion of tubing-casing annulus below said hanger, said cylindrical body being slidably movable to open and closed positions which allow and prevent, respectively, communication between said portions of said tubing-casing annulus above and below said hanger through said flow-through passages;

biasing means, positioned on said hanger and contacting said cylindrical body, for producing a force urging said cylindrical body to said closed position;

control fluid passage means, located in said hanger and communicating between said cylindrical body and said mandrel member positioned within said hanger bore, for passing a control fluid from said mandrel member through said hanger to said cylindrical body; and fluid-receiving shoulder means, located on said inner surface of said cylindrical body below said control fluid passage means, for receiving said control fluid passed from said mandrel member, whereby, when the pressure of said fluid on said shoulder means is greater than the force produced by said biasing means, said cylindrical body is slidably moved by said fluid along said hanger to said open position.

4. In an oil well equipment apparatus, a tubing hanger containing an integrated annulus valve for controlling fluid flow through a tubing-casing annulus formed between a casing and a tubing suspended within and generally concentrically to said casing, said tubing being connected to said hanger, said hanger landed within said casing in sealing relation thereto closing said annulus and comprising:

a hanger body, said body including an inner bore in said body aligned with the associated tubing bore, said bore accepting a mandrel communicating with said tubing bore;

fluid flow passage means, located in said body and communicating between portions of said tubing-casing annulus above and below said hanger, for passing fluid therebetween;

passage opening means for allowing fluid flow through said pasasge means between said portions of said tubing-casing annulus above and below said hanger through said passage means;

mounting means for mounting said passage opening means for slidable movement along said body between passage open and passage closed positions;

a hydraulic fluid receiving annular chamber formed between said passage opening means and said body; and hydraulic actuating means, operable from said mandrel, for acting on said passage opening means by supplying hydraulic fluid from within said body to said chamber to activate said passage opening means to said passage open position.

5. A tubing hanger containing an annulus valve as defined in claim 4, wherein said hydraulic actuating means comprises:

a control fluid passage communicating between said passage opening means and said hanger bore, said passage accepting a hydraulic fluid from said mandrel inserted into said hanger bore; and annular shoulder means, formed upon an inner surface of said passage closure means forming said chamber, for receiving said control fluid, the force of said control fluid on said shoulder means urging said passage opening means to said passage open position.

6. An annulus valve apparatus for controlling fluid flow through a tubing-casing annulus formed between a casing and an inner tubing, said apparatus being landed with said casing in sealing relation thereto closing said annulus, being connected into said tubing and having an apparatus bore communicating with said tubing bore, said apparatus comprising:

an apparatus body having passage means therein, communicating between portions of said tubing-casing annulus above and below said apparatus for passing fluid therebetween;

hydraulically-actuated means including a sleeve member slidably mounted on said body for selectively opening and closing said passage means to fluid flow therethrough;

a hydraulic fluid receiving chamber formed within said sleeve member; and means for supplying hydraulic fluid to said chamber from a location remote therefrom, said fluid activating said sleeve member from a closed to an open position relative to said passage means, and wherein said means for supplying hydraulic fluid comprises at least one control fluid passage in said apparatus body communicating with said chamber.

* * * * *